United States Patent [19]

Thoeny

[11] Patent Number: 4,550,544

[45] Date of Patent: Nov. 5, 1985

[54] METHOD FOR FORMING STRUCTURES

[76] Inventor: Theodore T. Thoeny, 1054 Haviland Ter., Seaside, Calif. 93955

[21] Appl. No.: 523,887

[22] Filed: Aug. 17, 1983

[51] Int. Cl.[4] ..... E04B 1/34

[52] U.S. Cl. ..... 52/741; 52/2; 52/309.8; 264/32; 264/45.2

[58] Field of Search ..... 52/2, 741, 309.8; 264/32, 45.2

[56] References Cited

U.S. PATENT DOCUMENTS

| | | | |
|---|---|---|---|
| 3,170,828 | 2/1965 | Irvine | 52/2 X |
| 3,277,219 | 10/1966 | Turner | 52/2 X |
| 3,324,611 | 6/1967 | Gamber | 52/91 |
| 3,815,301 | 6/1974 | Beard et al. | 52/92 |
| 3,973,367 | 8/1976 | Johnson et al. | 52/262 |
| 4,041,671 | 8/1977 | Nicholson | 52/741 |
| 4,241,555 | 12/1980 | Dickens et al. | 52/454 |
| 4,265,961 | 5/1981 | Bena | 428/253 |
| 4,307,554 | 12/1981 | Morrison et al. | 52/2 X |
| 4,324,074 | 4/1982 | South et al. | 52/2 |
| 4,365,455 | 12/1982 | Braine | 52/741 |

*Primary Examiner*—Carl D. Friedman

*Attorney, Agent, or Firm*—Leonard Bloom

[57] ABSTRACT

A system for forming structures, such as buildings, including the forming of a foundation slab, attaching flexible wall panels to the periphery of the foundation in a serial overlap configuration, installing prefabricated windows and doors, draping and attaching a membrane over the top of the wall panels, inflating the membrane upwardly to form a surface upon which to spray a foam substance, and spraying the foam to either the interior or exterior surfaces of the structure, including the roof membrane, so that an economical and energy efficient building can be provided at a low cost.

22 Claims, 6 Drawing Figures

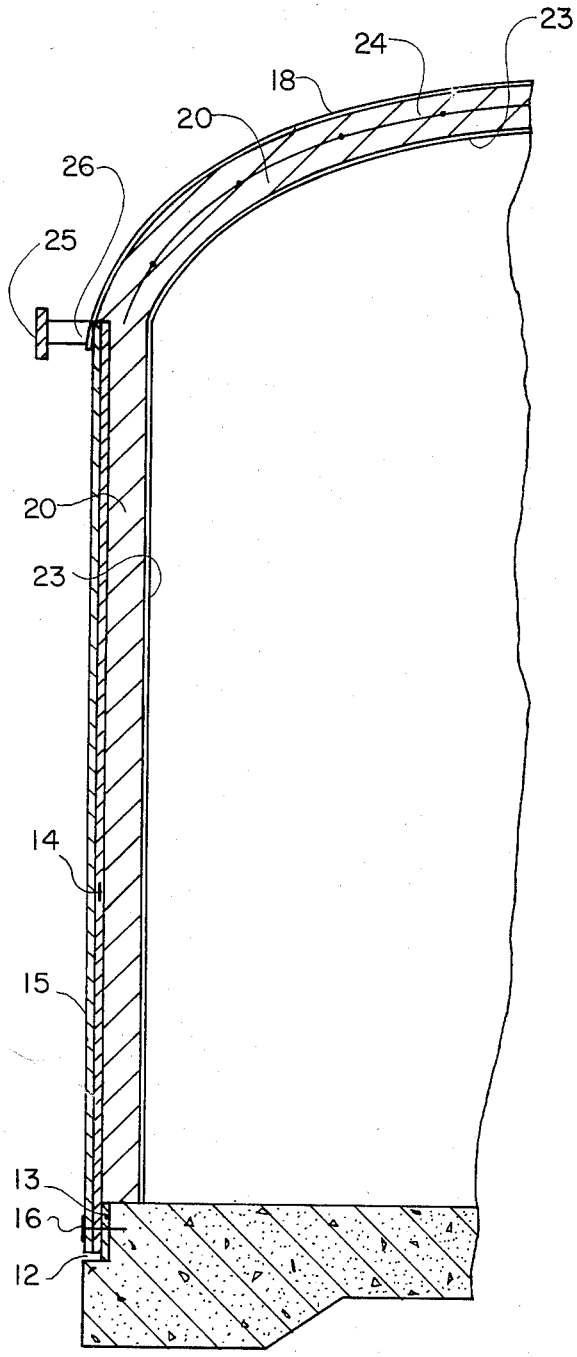
FIG 3
FIG 4
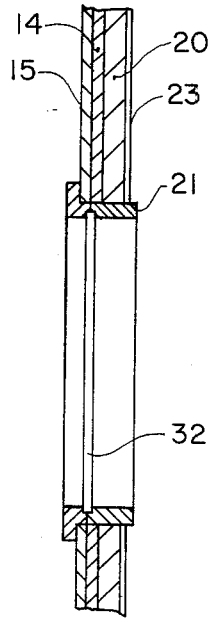
FIG 5
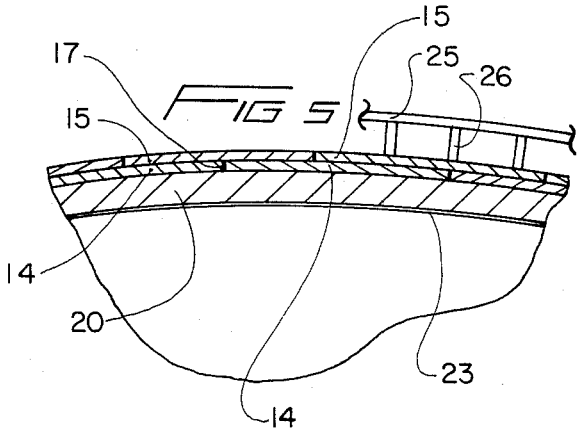
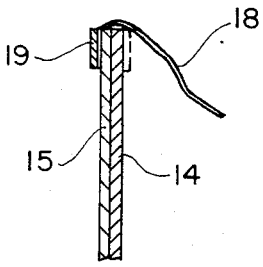
FIG 6

METHOD FOR FORMING STRUCTURES

BACKGROUND OF THE INVENTION

The instant application relates generally to a method for forming structures and more specifically to a method for constructing a building which may be used as a dwelling.

Due to the rising cost in producing adequate housing, there has been a dramatic increase in the methods and materials used for constructing good looking and economical dwelling structures. The costs of materials and labor of a custom built home have put the price of such a home beyond the reach of those of normal means. Therefore, a plethora of pre-fabricated building structures and structures constructed from kits have been proffered to the consumer claiming to fill the need for low cost, economical, yet attractive dwelling structures. However, prior art devices along these lines are replete with problems and inadequacies. For example, many prior art devices will not meet building or fire codes and exhibit other problems associated with appearance, energy efficiency, and structural integrity. Furthermore, many of the pre-fabricated or kit-type structures are not amenable to erection on a difficult or remote site which may be chosen as the location for a second or vacation home in the mountains, at the beach or anywhere else that presents unique site requirements.

Prior art devices require extensive structural members to be erected and fastened together to create a structural framework to which walls and roofs are attached. This increases the time, labor and materials involved in erecting the structure. These problems are greatly alleviated or eliminated by the structure according to applicant's disclosure which provides a unique way of forming walls and roofs wherein the forming process provides the structural integrity needed to support the entire structure. Therefore, there is a strong felt yet unfulfilled need for the building method according to applicant's disclosure which provides a low cost, energy efficient, and attractive method for forming economical building structures.

The following citations represent the prior art of which applicant is aware that would appear to be germane to the patent process: U.S. Pat. Nos. 3,324,611, Gamber, 3,643,393, Pierce, et al., 3,815,301, Beard, et al., 3,973,367, Johnsen, et al., 4,241,555, Dickens, et al., 4,265,961, Bena.

The patent to Dickens et al. is of interest since he teaches the use of a composite panel structure and an associated method of manufacturing in which the building panel has an expanded plastic core which is first molded and then removed from the mold so as to allow reinforcing strips to be placed on the front and back surfaces thereof. The instant application is easily distinguished in that the structure to the disclosure is itself molded over a form created from wall panels and an inflated or supported membrane so that the forming and molding process also provides the structural shell which supports the structure. The panels formed according to Dickens are prefabricated and then assembled, which is not the case in the instant disclosure.

The remaining references show the state of the art further. For example, Beard et al. teaches the use of applying polyurethane on a roof to form the roof and seal it into a single unit. Thus a supporting surface is provided upon which the polyurethane is to be sprayed.

OBJECTS AND SUMMARY OF THE INVENTION

Accordingly, it is a primary object of the present invention to provide a novel method and apparatus for forming structures which are economical, energy efficient, easily constructed on any site, and utilize modern techniques and materials.

It is a more particular object of the present invention to provide a novel method for forming structures which greatly reduces the numbers and size of structural members employed, thereby reducing the cost of labor and materials utilized in construction.

It is another object of the present invention to provide a novel method and apparatus for forming structures which can be erected in a minimal amount of time due to the efficiency of the techniques performed.

It is a still further object of the present invention to provide a novel method and apparatus for forming structures which utilizes a membrane supported in any desired configuration upon which a foam material is sprayed to form the roof of a structure.

It is still another object of the present invention to provide a novel method and apparatus for forming structures which utilizes air pressure to inflate a membrane of any desired shape upon which a foam material is sprayed to form the roof of a structure, thereby eliminating the need to erect structural members upon which a roof is built.

It is a further object of the present invention to provide a novel method and apparatus for forming structures in which the configuration of the roof portion is predetermined by adjusting the draping of the membrane upon which the foam is sprayed, thereafter using air pressure to inflate the membrane to the convex protrubance which represents the form upon which the roof is fashioned.

It is yet another object of the present invention to provide a novel method and apparatus for forming a structure which can be used to foam structures of various size, shape, and configuration according to the desires of the builder. Thus structures of conventional configurations can be erected using the method of the instant disclosure.

It is a still further object of the present invention to provide a novel method and apparatus for forming structures in which a finished structure formed thusly may be easily expanded by simply cutting through a foam wall and casting a further foundation upon which wall forms are erected with a membrane draped across the top thereof, the membrane being inflated before the entire structure is sprayed with a foam substance.

These and other objects and features of the instant invention will become apparent when viewed in light of the following description taken in conjunction with the appended drawing figures.

BRIEF DESCRIPTION OF THE DRAWINGS

FIG. 3 is a sectional view of that which is shown in FIG. 2 taken along lines 3—3.

FIG. 4 is a sectional view of that which is shown in FIG. 2 taken along line 4—4.

FIG. 5 is a sectional view of that which is shown in FIG. 2 taken along lines 5—5.

FIG. 6 is a side sectional view of a top portion of the wall panels showing the membrane attached to the top thereof prior to inflation and foaming.

DESCRIPTION OF THE PREFERRED EMBODIMENT

Figure 1:
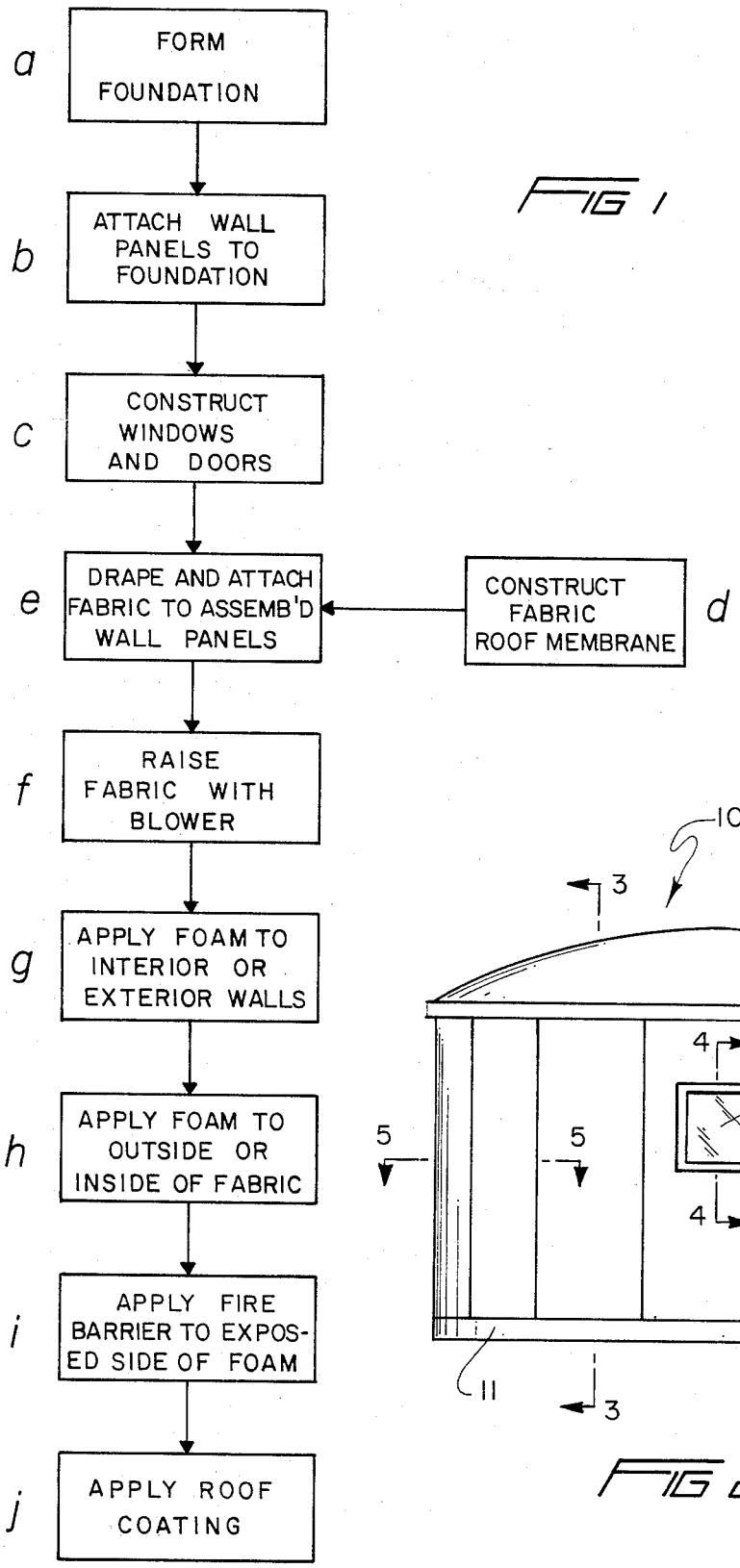
FIG. 1 is a flowchart depicting the various steps involved in the method associated with the instant invention.
Figure 2:
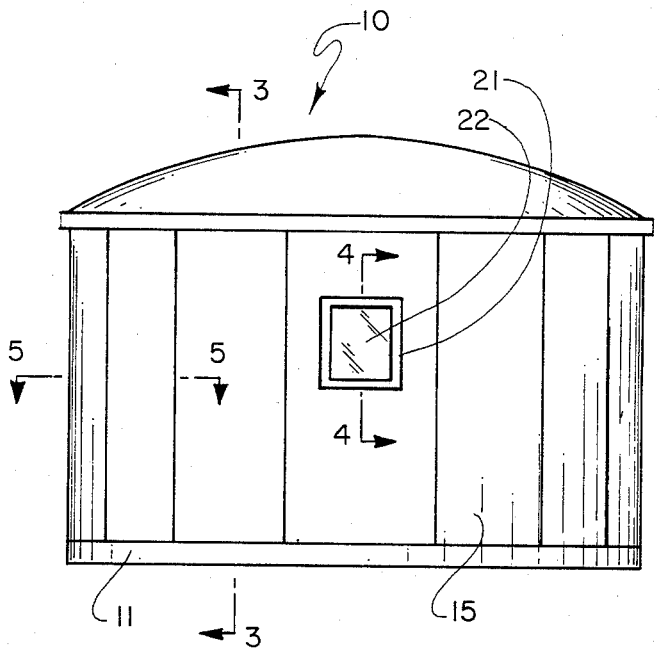
FIG. 2 is a side view of a simple structure fashioned according to the method of the invention.

Referring now to the drawings in detail wherein like reference numerals represent like parts throughout the several figures, reference numeral 10 refers generally to a structure formed according to the method of the instant invention.

The first step in the method, step (a) in the flowchart, involves pouring a foundation slab of concrete or the like upon which to erect a structure. As shown in FIG. 3, the foundation slab has on an outer peripheral edge a stepped portion 12 with a vertical baseboard 13 which was part of the form into which the concrete was poured. The baseboard 13 is left intact after the remainder of the concrete form is removed. The inner wall panels 14 and the outer wall panels 15 are attached to the baseboard 13 and the slab 11 by means of fasteners 16. The wall panels 14 and 15 may consist of sheets of plywood or any similar substance which can be readily flexed for conformational engagement with the peripheral edges of the slab 11 if the slab is non-rectitinear in configuration. By way of example only, a slab may be poured in a circular configuration such that two circles intersect, or are tangential, thereby requiring the wall panels 14 and 15 to conform to curved peripheral surfaces along the slab 11. Therefore, a material must be chosen for wall panels which is flexible enough to conform to various configurations yet provide the structural integrity to stand up alone.

As indicated by step (b), the wall panels 14 and 15 are attached to the slab somewhat above the stepped portion 12. One inner panel 14 is applied to the slab first, then an outer panel 15 is applied halflapping the inner panel such that adjacent edges 17 of inner panel 14 directly underlie an outer panel 15, as best shown in FIG. 5. This overlapping configuration of inner and outer panels is continued around the entire periphery of the slab 11 until a contiguous wall form is constructed. The outer panels 15 may be adhesively bonded to the inner panels 14 to ensure structural integrity and conformational engagement.

As indicated by step (c), after a contiguous wall panel form has been constructed, prefabricated doors and windows may be installed by cutting appropriately sized holes in the wall panels then installing windows 22, doors, or the like as shown in FIG. 4. After the desired windows and doors have been framed into the wall panels 14 and 15, then the electrical and plumbing conduits are applied accordingly to the interior surface of the inner wall panel. Similarly, any interior walls designed to carry electrical conduit may be framed out at this point or subsequent to inflating the roof membrane.

As indicated by step (d), a fabric membrane is constructed from any flexible but strong membrane material of fabric such as cloth, polyethylene or the like. The membrane 18 must be relatively impervious to air flow, or if it is not, it must receive a coating of a sealant to close any pores in the membrane. The membrane 18 need not be formed in any particular shape, as long as it is large enough to encompass the perimeter defined by the wall panels 14 and 15. If necessary, bolts of fabric may be sewn together to form a large sheet capable of encompassing the entire structure.

After a membrane of sufficient size is constructed, as indicated by step (d), then the membrane is draped over the entire structure such that middle portions of the membrane hang lower than peripheral portions of the membrane which will be attached to top of the wall panels 14 and 15. The shape and configuration of the membrane 18 is then adjusted, keeping in mind that when attached and inflated it will become the converse of the configuration observed in the draped mode. Thus the height and configuration of the ceiling to be formed is predetermined by adjusting the drape of the membrane 18 to a contour complemental to the shape desired to be made prior to inflation of same. As shown in FIG. 6, the membrane 18 may be attached to the upper edge of the outer wall panel 15 by means of a strip 19 which is attached to the upper peripheral edge of the outer wall panel 15 with the membrane 18 captured therebetween. Alternatively, the strip 19 may be placed on the interior panel 14 by placing the strip on the interior surface, as shown in phantom in FIG. 6.

After all the portals such as windows and doors are closed and sealed, an air blower is used to draw air from the outside of the structure to the inside of the structure, thereby creating a slight high pressure area within the structure which forces the membrane 18 to inflate and rise upwardly to the configuration desired. The strip 19 holds the membrane 18 in place and seals same along the entire upper periphery of the wall panels 14 and 15. After the membrane 18 has been raised by the blower, as indicated in step (f), the structure is ready for the application of a foam to either the interior or exterior wall and membrane surfaces.

It should be noted that the membrane 18 may also be supported by temporary structural members (not shown) in order to form roof shapes complemental with a desired configuration which is more readily achieved by suspending the membrane 18 rather than inflating it.

As indicated in step (g), a foam substance is then applied to the interior or exterior surfaces of the structure including the wall panels 14 and 15, but not the windows and doors, and the membrane 18 which forms a template upon which the foam is sprayed. The foam may be, but is not limited to, a polyurethane fire retardant foam which is sprayed onto desired surfaces. In one embodiment, the foam is sprayed onto the interior surfaces, the foam 20 adherring to the interior wall panels 14 and the interior of the membrane 18, as shown in FIGS. 3, 4, and 5. As shown in FIG. 4, the foam thus forms an interior wall 20 which is sprayed in sufficient thickness to approach the raised portion of the framing 21 of the window 22 which has been installed in the wall panels 14 and 15. Thus the foam forms a window casement around the window framing 21 while simsultaneously forming the interior wall surface 20. Typically, the foam components are sprayed together in a liquid form thereafter capturing gas in elemental bubbles and raising or increasing in thickness forming a rigid shell several inches thick. The foam spray is applied in layers until a desired thickness is reached.

In an alternate embodiment, the foam layer 20 may be applied to the exterior surfaces of the structure leaving the interior surfaces without foam. Similarly, a third embodiment contemplates applying the foam layer 20 to both the interior and exterior surfaces in a sandwich-type fashion with an optional structural reinforcement web 24 captured within the foam. In the first embodiment, the foam is applied to the interior surfaces thereby covering and hiding any electrical and/or pumbing conduits that have been applied to the interior surfaces of the structure, thereby eliminating the problems associated with cosmetic coverup at a later time. Thus as indicated by steps (g) and (h), the foam is applied to either the outside or the inside surfaces of the membrane 18 and wall panels 14 and 15. If the foam is applied to the outside of the panels 14 and 15, then the plumbing and electrical conduits are also installed on the outside so that the foam will cover them.

After the foam has had an opportunity to cure, a fire barrier 23 is applied to the exposed side of the foam layer 20. The fire barrier 23 may be a thin coat of conventional plaster or the like which forms an attractive textured interior wall surface which may thereafter be painted if desired. Similarly, plaster applied to the inner surface of the foam comprising the roof portion of the structure provides an attractive textured surface which may be painted or left as is. If the foam is applied to the outside of panels 14 and 15, then so is the plaster 23.

As indicated in step (j), a final coat of roof coating may be applied to the exterior foam surfaces in order to preserve same from the elements including rain and sun which may cause foam deterioration. Similarly, the exterior of the panels 14 and 15 may be finished with paint, plaster, shingles, etc., to present an attractive outer facade.

In order to control and gauge thickness to which the foam is applied a wire gauge (not shown) of a desired length may be pierced through the surface upon which the foam is to be sprayed thereby providing a visual gauge as to the progress of the foam spray. Thus a uniform thickness can be achieved by applying a number of wire gauges at various positions across the surfaces to be sprayed with the foam.

As an option, a stressing ring 25 may be installed with blocks 26 at an upper, outer edge of the outer panels 15 where the roof starts. The ring 25 serves to structurally reinforce the structure and provides an attractive facia board to trim the roof line.

It should be noted, that the form provides not only an insulation value, but its primary function is that of a structural member integral to the structural integrity of the entire edifice. Once the foam has cured, it is the sustaining element that holds the entire structure together and becomes a hard shell capable of supporting loads comparable to those applied to structures utilizing typical rectilinear construction techniques. Furthermore, if the structure needs to be enlarged or enhanced this is easily accomplished by cutting away the foam in a desired area, creating another form adjacent thereto and applying a new coat of foam to the form using the techniques disclosed hereinabove.

It should be noted further that numerous structural modifications and changes are contemplated as available for use without departing from the spirit of the invention. For example, the rounded structure shown in FIG. 1 is depicted for the purpose of explanation and example only, and it is contemplated by applicant to form structures of any desired configuration including those with the appearance of normal rectalinear construction techniques.

I claim:

1. A method for forming a structure comprising the steps of:

(a) Forming a foundation, (b) Attaching panels to said foundation to form an assembled panel construction, (c) Installing at least a door in said panels, (d) Fabricating an unshaped flexible membrane having a middle portion and further having a peripheral portion, (e) Draping said flexible membrane over the upper portion of said assembled panel construction, such that the middle portion of said membrane hangs down within said panel construction lower than the peripheral portion of said membrane, adjusting said membrane such that the draped mode of said membrane will be the reverse of the desired shape of the roof of the structure, thereafter attaching the peripheral portion of the membrane to the upper portion of the panel construction, and thereafter (f) Inflating said membrane with air pressure, (g) Applying foam to a surface of said panels, (h) Applying foam to a surface of said membrane, (i) Applying a fire barrier to the interior or exterior exposed side of said foam, and (j) Applying an exterior sealant to any exterior exposed foam surfaces, Whereby structures of various sizes and configurations can be constructed and modified without the necessity of an extensive structural framework.

2. The method of claim 1 wherein step (e), draping and attaching, further includes, draping said fabricated membrane from a top edge of all said panels such that central portions of said membrane hang lower than said top edges of said panels, adjusting the distance said central portions and peripheral portions of said membrane hang to appropriate levels so that when inverted upwardly said membrane forms the upper limit of a desired configuration of a roof for said structure, and making said membranes and said panels contiguous by attaching and sealing said membrane to at least one of outer or inner upper portions of said panels proximate to said upper edges of said panels.

3. The method of claim 1 wherein step (f), inflating said membrane, further includes, closing and sealing all orifices in said structure except one, and placing inflation means in the one remaining open orafice to force outside air into the interior of said structure creating a high pressure area therein which inflates said membrane upwardly creating a formed surface of a desired configuration upon which to spray foam.

4. The method of claim 1 wherein step (g), applying foam to a surface of said panels, further comprises, applying foam by means of spraying to a desired thickness upon the interior surfaces of said panels attached to said foundation, whereby said foam forms the interior walls of the said structure.

5. The method of claim 1 wherein step (h), applying foam to a surface of said membrane, further includes, applying foam by means of spraying to a desired thickness upon an interior surface of said membrane, whereby said foam forms a roof for said structure.

6. The method of claim 1 wherein step (i), applying a fire barrier, further includes, applying a coat of a fire barrier medium in a contiguous fashion on the interior or exterior surfaces of said structure, whereby said foam is isolated from direct exposure to the interior or exterior space of said structure.

7. The method of claim 1 wherein, step (j), applying exterior sealant, further includes, applying an exterior sealant medium to any exterior foam surfaces whereby said surfaces are thereby protected from elemental deterioration.

8. The method of claim 1 wherein steps (g) and (h), applying foam to surfaces of said panels and said membrane, further include, applying foam by means of spraying to a desired depth upon exterior surfaces of said panels and said membrane, whereby said structure is formed from applying foam to exterior surfaces rather than interior surfaces.

9. The method of claim 1 wherein steps (g) and (h), applying foam to said panels and said membrane, further include, applying foam by means of spraying to a desired depth upon both interior and exterior surfaces of said membrane and said panels, thereby forming said structure by means of a foam-sandwich construction.

10. A method for forming a structure comprising the steps of:

(c) Forming a foundation,
(b) Attaching panels to said foundation,
(c) Installing windows and doors in said panels,
(d) Fabricating a flexible membrane,
(e) Draping and attaching said flexible membrane to said assembled wall panels,
(f) Inflating said membrane with air pressure,
(g) Applying foam to a surface of said panels,
(h) Applying foam to a surface of said membrane,
(i) Applying a fire barrier to the interior or exterior exposed side of said foam, and
(j) Applying an exterior sealant to any exterior exposed foam surfaces, Whereby structures of various sizes and configurations can be constructed and modified without the necessity of an extensive structural framework; and wherein step (a), forming a foundation, further includes, pouring a concrete slab within the confines of a two piece form such that a narrow, contiguous transverse step is formed along the periphery of said/-slab, and retaining an upper contiguous portion of said two piece form which comprises a vertically disposed peripheral baseboard surrounding an upper edge portion of said slab above said step.

11. A method for forming a structure comprising the steps of:

(a) Forming a foundation,
(b) Attaching panels to said foundation,
(c) Installing windows and doors in said panels,
(d) Fabricating a flexible membrane,
(e) Draping and attaching said flexible membrane to said assembled wall panels,
(f) Inflating said membrane with air pressure,
(g) Applying foam to a surface of said panels,
(h) Applying foam to a surface of said membrane,
(i) Applying a fire barrier to the interior or exterior exposed side of said foam, and
(j) Applying an exterior sealant to any exterior exposed foam surfaces, Whereby structures of various sizes and configurations can be constructed and modified without the necessity of an extensive structural framework; and wherein step (b), attaching panels to the foundation, further includes, fastening a first, inner panel to said baseboard above said step such that panel conforms generally to the configuration of said baseboard and said slab, fastening a first outer panel to an outer surface of said first inner panel so that said second panel half-laps said first panel, fastening a second said inner panel to an inner surface of said first outer panel with vertical edges of said first and second inner panel in abutting engagement, and serially continuing the fastening of further said inner and outer panels to said baseboard and to one another around the periphery of said slab forming vertical wall forms.

12. A method for forming a structure comprising the steps of:

(a) Forming a foundation,
(b) Attaching panels to said foundation,
(c) Installing windows and doors in said panels,
(d) Fabricating a flexible unshaped membrane having a middle portion and further having a peripheral portion,
(e) Draping said flexible unshaped membrane over the panels, such that the middle portion of said membrane hanges down within said panels lower than the peripheral portion of said membrane, adjusting said membrane such that the draped mode of said membrane will be the reverse of the desired shape of the roof of the structure, thereafter attaching the peripheral portion of the membrane to the panels, and thereafter
(f) Inflating said membrane with air pressure,
(g) Applying foam to a surface of said panels,
(h) Applying foam to a surface of said membrane,
(i) Applying a fire barrier to the interior or exterior exposed side of said foam, and
(j) Applying an exterior sealant to any exterior exposed foam surfaces, Whereby structures of various sizes and configurations can be constructed and modified without the necessity of an extensive structural framework; and wherein step (c), installing windows and doors, further includes, cutting out portions of said vertical walls to receive windows and doors, framing said cut-out portions, and installing the windows and doors therein.

13. A method for forming a structure comprising the steps of:

(a) Forming a foundation,
(b) Attaching panels to said foundation to form an assembled panel construction,
(c) Installing at least a door in said panels,
(d) Fabricating an unshaped flexible membrane,
(e) Attaching and draping said flexible membrane to an upper portion of said assembled panel construction,
(f) Inflating said membrane with air pressure,
(g) Applying foam to a surface of said panels,
(h) Applying foam to a surface of said membrane,
(i) Applying a fire barrier to the interior or exterior exposed side of said foam, and
(j) Applying an exterior sealant to any exterior exposed foam surfaces, Whereby structures of various sizes and configurations can be constructed and modified without the necessity of an extensive structural framework, and wherein step (d), fabricating a flexible membrane, further includes, fabricating a contiguous, large, flexible, relatively light membrane large enough to overlie said panels on said foundation with substantial excess in all directions, and spraying said membrane with a sealant if necessary to make said membrane relatively impervious to air flow therethrough.

14. A method for forming a structure comprising the steps of:

(a) Forming a foundation, (b) Attaching panels to said foundation to form an assembled panel construction, (c) Installing at least a door in said panels, (d) Fabricating an unshaped flexible membrane having a middle portion and further having a peripheral portion, (e) Draping said flexible unshaped membrane over the panels, such that the middle portion of said membrane hangs down within said panels lower than the peripheral portion of said membrane, (f) adjusting said membrane such that the draped mode of said membrane will be the reverse of the desired shape of the roof of the structure, (g) thereafter attaching the peripheral portion of the membrane to the panels, and thereafter (h) Inflating said membrane with air pressure, (i) Applying foam to a surface of said panels, and (j) Applying foam to a surface of said membrane.

15. A method for forming a building structure, comprising the steps of:

(a) Providing a foundation;

(b) Providing inner and outer upstanding panels, each of which has respective upper and lower portions and respective vertical side edges, and arranging the respective panels in an overlapping relationship relative to the respective vertical side edges of the panels;

(c) Securing the lower portions of the panels to the foundation;

(d) Providing a membrane, and attaching said membrane to the upper portions of the panels;

(e) providing at least one access opening in the panels; and (f) applying foam to at least one of the interior and exterior surfaces of the building structure.

16. The method of claim 15, wherein a first inner panel is secured to the foundation; wherein a first outer panel is arranged in an overlapping relationship with respect to the first inner panel and is secured thereto, and wherein the sequence is continued to form an assembled panel structure.

17. The method of claim 15, wherein the membrane is flexible and made sufficiently non-porous and is draped over the panels, and wherein the membrane is inflated by air pressure prior to applying the foam.

18. The method of claim 15, wherein the step of forming at least one access opening comprises the step of forming a door and at least one window in the building structure.

19. The method of claim 15, wherein the panels are made of plywood, and wherein the step of attaching the membrane to the upper portion of the panels includes the step of attaching a thin strip to the respective tops of the plywood panel, to retain the membrane.

20. A method of forming a building structure, comprising the steps of:

(a) Providing a foundation;

(b) Providing inner and outer upstanding panels, each of which has respective upper and lower portions and respective vertical side edges, and arranging the respective panels in an overlapping relationship relative to the respective vertical side edges of the panels;

(c) Securing the lower portions of the panels to the foundation and to each other;

(d) Providing a substantially flexible membrane, (e) Draping the membrane over the assembled panel structure, and attaching the membrane to the upper portions of the assembled panels;

(f) Providing at least one access opening in the assembled panels;

(g) Substantially sealing the interior of the building structure;

(h) Inflating the membrane with air pressure;

(i) Applying foam to a surface of said membrane; and (j) Applying foam to a surface of said panel structure.

21. The method of claim 20, wherein the foam is applied to both interior and exterior surfaces of the membrane and the panels.

22. The method of claim 21, further including the step of providing a fire barrier on the interior foam surface.

* * * * *